United States Patent [19]

Baker

[11] 3,965,494

[45] June 29, 1976

[54] REDUCED LIQUID CONSUMPTION CLEANING APPARATUS

[76] Inventor: Larry K. Baker, Mokelumne Hill, Calif.

[22] Filed: June 28, 1974

[21] Appl. No.: 484,076

Related U.S. Application Data

[63] Continuation of Ser. No. 281,216, Aug. 16, 1972, abandoned.

[52] U.S. Cl. ..... 4/145; 4/161

[51] Int. Cl.[2] ..... A61H 33/02

[58] Field of Search..... 4/145, 146, 147, 160–164; 128/173.1

[56] References Cited

UNITED STATES PATENTS

| | | | |
|---|---|---|---|
| 1,501,762 | 7/1924 | Ferguson | 4/145 |
| 3,281,864 | 11/1966 | Linnehan | 4/161 |

FOREIGN PATENTS OR APPLICATIONS

| | | | |
|---|---|---|---|
| 22,872 | 8/1910 | United Kingdom | 4/145 |
| 1,208,431 | 3/1968 | United Kingdom | 4/145 |

*Primary Examiner*—Richard E. Aegerter
*Assistant Examiner*—Willis Little
*Attorney, Agent, or Firm*—George Edmund Clark

[57] ABSTRACT

Liquid flow rate and thus volume consumed is reduced in a cleaning system which includes means for supplying a gas under high flow rate, low pressure to a mixing nozzle, and means for supplying a cleaning liquid to the mixing nozzle where the liquid and gas are combined so that the pressurized gas flow carries liquid droplets to a surface to be cleaned.

15 Claims, 5 Drawing Figures

REDUCED LIQUID CONSUMPTION CLEANING APPARATUS

This is a continuation, of application Ser. No. 281,216 filed Aug. 16, 1972 now abandoned.

BACKGROUND OF THE INVENTION

The present invention relates to cleaning systems and more particularly to cleaning systems wherein a cleaning liquid is mixed with and carried by a pressurized gas.

Prior art cleaning systems, such as shower bathing systems, use a high volume, high flow rate, liquid only spray which requires a liquid flow rate of from 3 to 5 gallons per minute for durations of from 5 to 10 minutes to provide adequate cleaning. This results in a volume of clean liquid between 15 to 50 gallons being used.

Shower bathing systems and automatic dishwashers represent a major use of clean water in a household. Conservation of natural water resources and reduction of water pollution through sewage disposal can be achieved in a cleaning system which significantly reduces water consumption.

SUMMARY OF THE INVENTION

Therefore, it is a primary object of the present invention to reduce liquid consumption in a cleaning system.

It is another object of the present invention to reduce liquid consumption in a cleaning system by entraining the liquid onto a pressurized gas stream.

A further object of the present invention is to reduce liquid consumption in a cleaning system by entraining a heated cleaning liquid onto a saturated gas stream.

It is a still further object of the present invention to reduce liquid consumption in a cleaning system by entraining a cleaning liquid onto a heated gas stream.

It is a still further object of the present invention to reduce liquid consumption and energy requirements in a cleaning system by entraining a heated cleaning liquid onto a stream carrying gas recirculated from a chamber containing a surface to be cleaned.

It is another object of the present invention to reduce water consumption in a cleaning system by entraining water onto a pressurized air stream.

It is another object of the present invention to reduce water consumption in a cleaning system by entraining water onto a saturated pressurized air stream.

It is another object of the present invention to reduce water consumption and energy requirements in a cleaning system by entraining heated water onto an air stream carrying air recirculated from a chamber containing a surface to be cleaned.

It is yet another object of the present invention to reduce water consumption in a shower bathing apparatus by entraining water onto a pressurized, saturated air stream.

Accordingly, the present invention includes means for supplying a liquid, means for supplying a gas under low pressure at a high volume and means for entraining the liquid onto a stream of the pressurized gas to achieve a required cleaning effect with a reduced liquid flow and thus reduced liquid consumption.

The present invention may also include means for recapturing and recirculating a portion of the gas which has been heated by the entrained liquid.

An alternative to recycling a portion of the gas is to provide heating means at the output of the means for supplying gas under pressure.

It is to be noted, however, that recycling a portion of the gas which has absorbed heat from the liquid reduces the energy required for heating the liquid.

It is an advantage of the present invention that when embodied in a shower bathing apparatus the object of cleaning the surface of the skin can be achieved with a water flow rate of approximately one quart per minute while retaining the soothing subjective effects of water flow rates of approximately 3 to 5 gallons per minute.

At a minimum the present invention achieves a water consumption reduction of twelve to one (12:1). Stated another way, a shower bathing apparatus according to the present invention uses less than 10% of the water required by the prior art shower bathing systems.

Apparatus according to the present invention may also be advantageously used to reduce clean water consumption in other cleaning systems, such as automatic dishwashers.

The foregoing and other objects, features and advantages of the invention will be apparent from the following more particular description of preferred embodiments thereof as illustrated in the accompanying drawing.

DETAILED DESCRIPTION OF THE INVENTION

Figure 1:
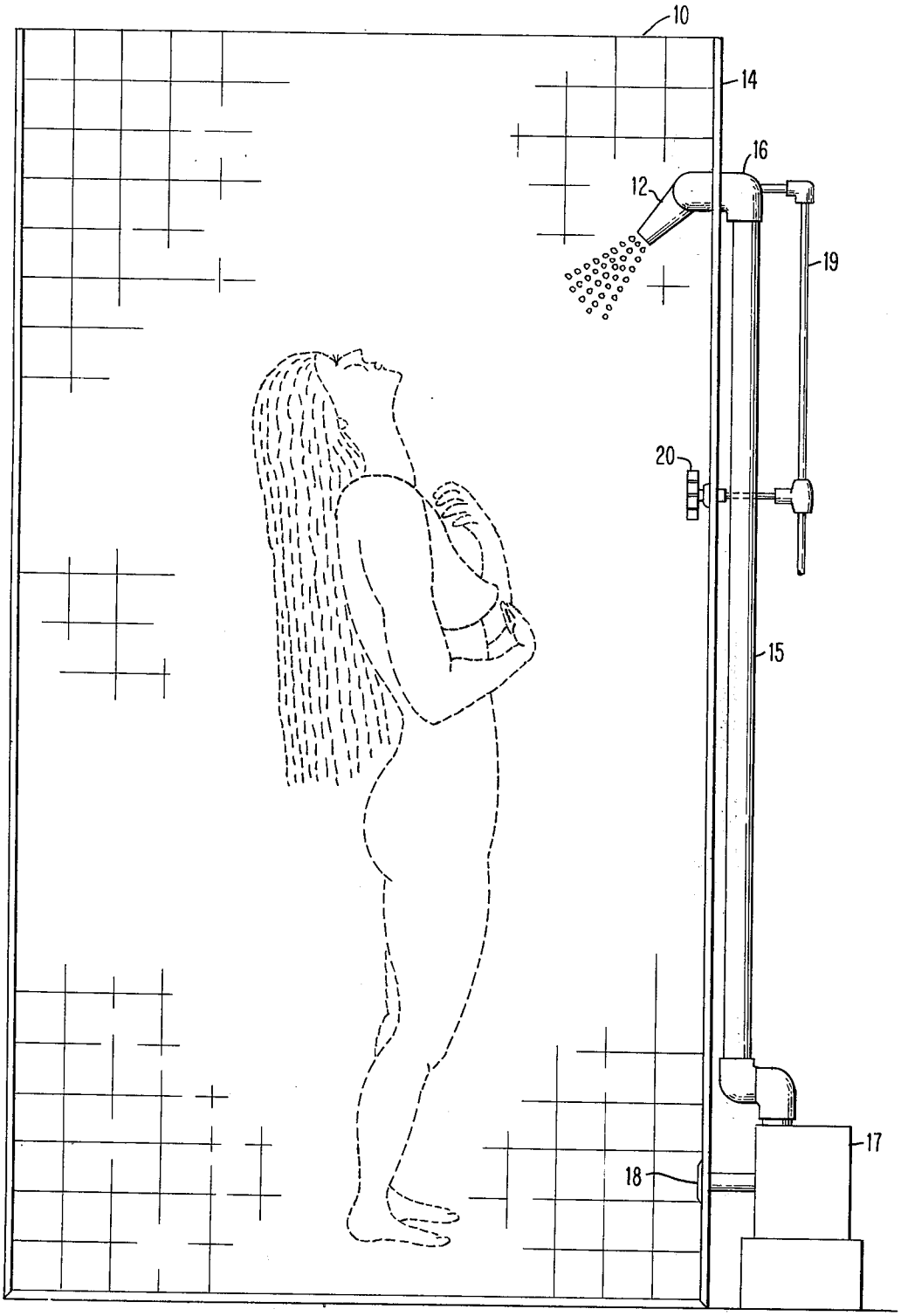
FIG. 1 is a cross section diagram of a shower bathing apparatus embodying the present invention.

A cleaning system which reduces water consumption is shown in FIG. 1, embodied as a shower bathing apparatus 10.

Nozzle 12 is movably mounted on wall 14. Air under a pressure of approximately 5 inches of water is supplied to nozzle 12 through elbow 16 by way of tube 15 and air compressor 17. An air intake 18 is mounted on the lower portion of wall 14 to collect saturated, warm air from the shower enclosure 10 for input to air compressor 17. Air compressor 17 may be a commercially available vacuum cleaner compressor operable on a 115 volt alternating current power supply.

Water is supplied to nozzle 12 from water mains (not shown) through pipe 19 under the control of volume and temperature control 20.

Figure 2:
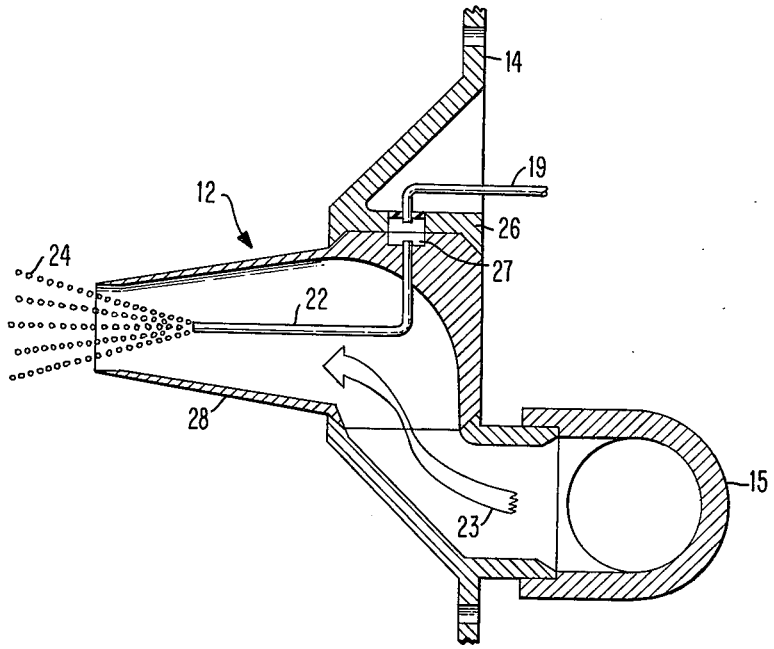
FIG. 2 is a top cross section diagram of a mixing means according to the present invention.

Referring now to FIG. 2, a top cross section view of nozzle 12, the mixing of the water into the air stream is shown in detail. Water pipe 19 is connected to tube 22 which emits a low volume (1 to 1.5 quart per minute) water flow which is entrained as droplets 24 on a high volume (50 to 100 cubic feet per minute) air stream 23.

Pipe 19 is connected to pivotable tube 22 at bushing 27 which is mounted in housing 26. Nozzle 12 is movable so that the cleaning spray may be directed to the portion of the surface to be cleaned as desired.

Figure 3A:
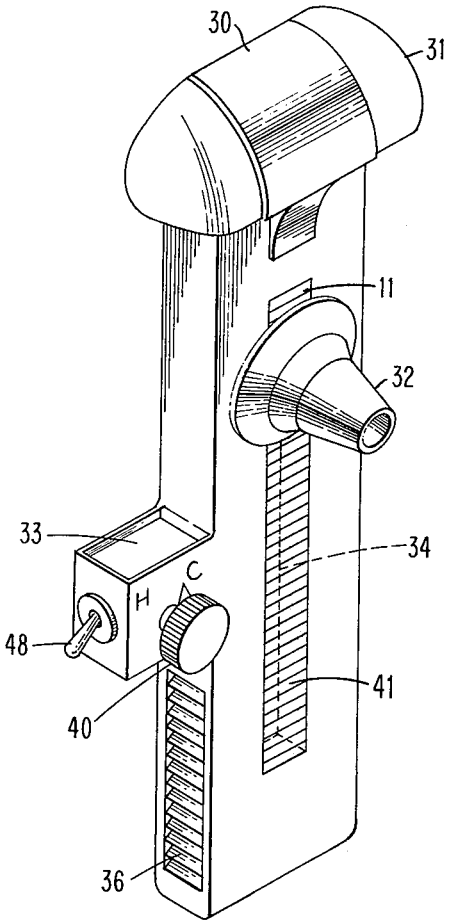
FIG. 3A is a front view of an alternate embodiment of the present invention.
Figure 4:
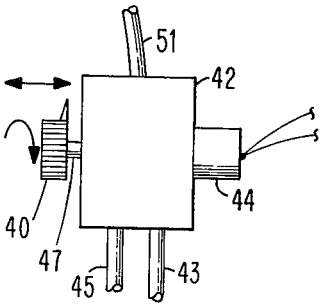
FIG. 4 is a schematic diagram of a combined temperature control and compressor switch which may be employed in apparatus embodying the present invention.
Figure 3B:
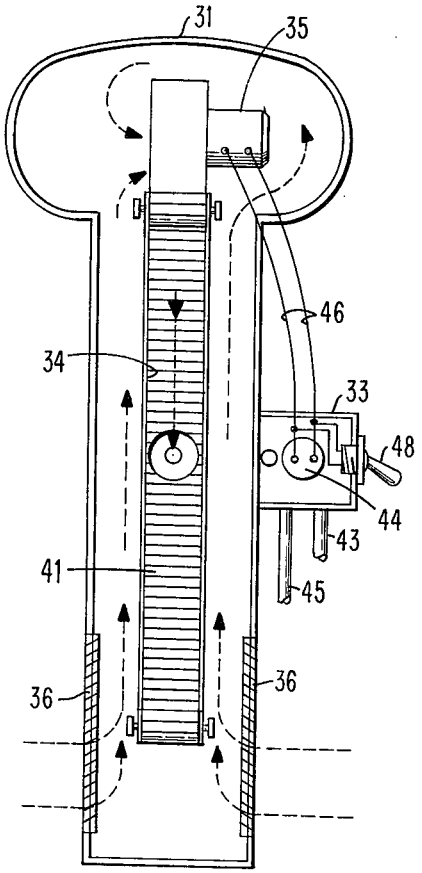
FIG. 3B is a rear section view of the alternate embodiment of FIG. 3A.

Referring to FIGS. 3A, 3B and 4, an alternate embodiment of the present invention will be described.

A shower bathing unit 30 is shown which includes a pivotable nozzle 32 which is slideably mounted in slot 34 for easy adjustment of nozzle height.

Nozzle 32 may be mounted in slot 34 with a friction fit to avoid undesired sliding of the nozzle.

Housing 31 provides a return passage for air drawn in through inlets 36 near the base of the unit 30. The air drawn through inlets 36 is pressurized by compressor 35 and directed to nozzle 32 by way of air tight slot 34 which is closed to ambient air by slideable cover 41.

Nozzle 32 may be constructed as shown in FIG. 2.

Water is fed to nozzle 32 through a flexible tube (not shown) which is connected to temperature control and valve means 42 (shown in FIG. 4). Water pipes 43 (cold) and 45 (hot) supply water to control 42 from water mains (not shown) or from storage tanks (not shown). For a nominal shower of 5 minutes at 1.5 quarts per minute with a hot to cold water ratio of 2:1, a six quart hot water storage tank and a three quart cold water storage tank would be sufficient.

Temperature control and valve 42 and compressor switches 44 and 48 are mounted in housing 33.

Referring now to FIG. 4, temperature control knob 40 is connected to temperature control and valve means 42 and compressor switch 44 by concentrically mounted shaft 47 so that water flow and power onto compressor 35 (FIG. 3B) are initiated by motion of knob 40 in the horizontal plane (as shown in FIGS. 3A and 4).

Temperature control of the water flowing to nozzle 32 via tube 51 is affected by rotation of knob 40.

Temperature control and valve means 42 and concentrically mounted compressor switch 44 are units well known in the art and are commercially available.

Referring again to FIGS. 3A and 3B, a single pole, single throw toggle switch 48 is connected in parallel with compressor switch 44 to enable activation of air flow from compressor 35 through nozzle 32 without water flow. Switch 48 may be used to supply an air stream for drying a surface after it has been washed. This feature is especially beneficial for hair drying.

A cleaning system according to the present invention uses less energy than a full flow water only cleaning system. The following calculations illustrate the difference.

WATER ONLY SHOWER

Assuming a 50°F. temperature rise at a flow rate of 3 gallons per minute, 1200 BTU per minute are required.

REDUCED FLOW AIR-WATER SHOWER

50°F. temperature rise at a flow rate of 0.25 gallon per minute (1 quart) requires 100 BTU per minute.

The compressor requires 115 volts at 7 amperes or 805 watts which is equivalent to 45.8 BTU per minute.

Therefore, the present invention requires only 145.8 BTU per minute as opposed to 1200 BTU per minute for the prior art systems. This is an energy reduction ratio of greater than 8:1.

It is an advantage that a cleaning system embodying the present invention can be installed in a portable vehicle where liquid storage space is very limited. Examples of this application are recreational vehicles and seagoing vessels.

While the present invention has been described with reference to preferred embodiments thereof, it is understood by those skilled in the art that various changes in form and application of the novel cleaning system may be made without departing from the spirit or scope of the invention.

What is claimed is:

1. A reduced liquid consumption cleaning system, comprising:

Means for supplying a cleaning liquid under pressure;

Means for supplying a gas under pressure;

An enclosure for containing a surface to be cleaned,

Means connected to said liquid supply means and said gas supply means for entraining droplets of said cleaning liquid on a stream of said pressurized gas, said entraining means comprising:

a first passageway for said pressurized gas;

a second passageway for said cleaning liquid, said second passageway being substantially parallel to said first passageway in said entraining means to provide an effective cleaning spray with reduced liquid consumption in said enclosure; and Means connected between said enclosure and said gas supply means for recirculating a portion of said stream of pressurized gas.

2. A low water consumption shower system for bathing, comprising:

Means for supplying water under pressure;

Means for supplying air under pressure;

An enclosure for containing a surface to be cleaned;

Means connected to said water supply means and said air supply means for entraining droplets of water from said water supply means onto a stream of said pressurized air, said entraining means comprising:

a first passageway for said pressurized air;

a second passageway for said water, said second passageway being substantially parallel to said first passageway in said entraining means;

Means connected between an input to said means for supplying a stream of air under pressure and said enclosure to recirculate a portion of air used for cleaning to reduce system energy consumption.

3. A reduced liquid consumption cleaning system, comprising:

Means for supplying a volume of a cleaning liquid under pressure;

Means for supplying a volume of gas under pressure;

Means connected to said liquid supply means and said gas supply means for entraining droplets of said liquid on a stream of said pressurized gas, said entraining means comprising:

a first passageway for said pressurized gas; terminating in said entraining means and a second passageway for said cleaning liquid, said second passageway whereby said liquid is efficiently entrained on said stream of pressurized gas to reduce liquid consumption being substantially parallel to said first passageway in said entraining means; and valve means connected to one of said supply means for controlling the rate of flow of such supply that the volume of gas issuing from said entraining means is substantially greater than the volume of liquid issuing from said entraining means.

4. A cleaning system according to claim 3, further comprising:

means to heat said pressurized gas to increase liquid carrying capacity.

5. A cleaning system according to claim 3, further comprising:

means for mixing liquid from a first source of cleaning liquid with liquid from a second source of cleaning liquid to obtain a cleaning liquid to be entrained on said pressurized gas stream.

6. A cleaning system according to claim 3, further comprising:

means for containing a surface to be cleaned.

7. A reduced liquid consumption cleaning system according to claim 3 wherein said volume of gas is at least one hundred times said volume of liquid.

8. A reduced liquid consumption cleaning system according to claim 3 wherein the ratio of said volume of gas to said volume of liquid is in the range of five hundred to five thousand.

9. A low water consumption shower bathing system comprising:

Means for supplying a volume of water under pressure;

Means for supplying a volume of air under pressure:

Means connected to said water supply means and said air supply means for entraining droplets of water from said water supply means onto a stream of said pressurized air, said entraining means comprising:

a first passageway for said pressurized air;

a second passageway for said water, said second passageway terminating in said entraining mean and being substantially parallel to said first passageway in said entraining means whereby said liquid is efficiently entrained on said stream of pressurized gas to reduce liquid consumption.

10. A shower bathing system according to claim 9, further comprising:

means for controlling temperature and flow rate of water through said means for supplying water.

11. A shower bathing system according to claim 9, further comprising:

means for heating said air stream.

12. A shower bathing system according to claim 9, further comprising:

a bathing enclosure.

13. A shower bathing system according to claim 9 wherein:

said means for supplying water comprises a source of hot water, a source of cold water and a temperature control valve for mixing said hot and said cold water;

said means for supplying a stream of air under pressure comprises an air compressor with an air intake connected to a bathing enclosure, an air output connected to a flexible air tube;

switch means for controlling the application of power to said air compressor; and said means for entraining droplets of water comprises an adjustable nozzle having a centrally mounted tube for emitting water and a passage for said air stream said passage being substantially parallel to said centrally mounted tube.

14. A low water consumption shower bathing system according to claim 9 wherein said volume of air is at least one hundred times said volume of water.

15. A method of cleaning a surface comprising the steps of:

Entraining a volume of a cleaning liquid on a stream of a pressurized gas by passing said stream of pressurized gas pass said cleaning liquid in a substantially parallel manner within an entraining means;

Directing said entrained stream against the surface to be cleaned; and

Recirculating a portion of the gas entrained with said liquid to reduce system energy consumption.

* * * * *